US011420460B2

(12) United States Patent
Iijima et al.

(10) Patent No.: US 11,420,460 B2
(45) **Date of Patent: *Aug. 23, 2022**

(54) PRINTING DEVICE HAVING RECEIVING PORTION FOR SELECTIVELY RECEIVING ONE OF FIRST CASSETTE AND SECOND CASSETTE

(71) Applicant: BROTHER KOGYO KABUSHIKI KAISHA, Nagoya (JP)

(72) Inventors: Shota Iijima, Nagoya (JP); Takanori Izumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/164,215

(22) Filed: Feb. 1, 2021

(65) Prior Publication Data

US 2021/0229477 A1 Jul. 29, 2021

Related U.S. Application Data

(63) Continuation of application No. 16/734,324, filed on Jan. 4, 2020, now Pat. No. 10,933,673.

(30) Foreign Application Priority Data

Feb. 26, 2019 (JP) ..... JP2019-032869

(51) Int. Cl.
*B41J 32/00* (2006.01)
*B41J 3/407* (2006.01)
*B41J 11/70* (2006.01)

(52) U.S. Cl.
CPC ..... *B41J 32/00* (2013.01); *B41J 3/4075* (2013.01); *B41J 11/703* (2013.01)

(58) Field of Classification Search
CPC ..... B41J 32/00; B41J 3/4075; B41J 11/703; B41J 29/02
See application file for complete search history.

(56) References Cited

U.S. PATENT DOCUMENTS 5,374,132 A 12/1994 Kimura
7,988,373 B2 8/2011 Vandermeulen
(Continued)

FOREIGN PATENT DOCUMENTS

CN 2097742 U 3/1992
CN 1085497 A 4/1994
(Continued)

OTHER PUBLICATIONS

Chinese Office Action for the related Chinese Patent Application No. 202010110703.5 dated Apr. 29, 2022.

*Primary Examiner* — Geoffrey S Mruk
(74) *Attorney, Agent, or Firm* — Kenealy Vaidya LLP

(57) ABSTRACT

A printing device includes: a housing; a print head extending in a first direction; a cassette receiving portion; and a movable cover. The cassette receiving portion is open in a second direction orthogonal to the first direction. The cassette receiving portion can selectively receive a first cassette or a second cassette whose size is greater than that of the first cassette. The movable cover is movable between a closed position and an open position for covering and exposing the cassette receiving portion in the second direction. The cassette receiving portion provides: a first cassette receiving portion for receiving the first cassette with the movable cover at the closed position; and a second cassette receiving portion for receiving the second cassette with the movable cover at the open position. A portion of the second cassette receiving portion is overlapped with the movable cover at the closed position in the first direction.

9 Claims, 8 Drawing Sheets

(56) References Cited

U.S. PATENT DOCUMENTS

| | | | | |
|---|---|---|---|---|
| 10,933,673 | B2 * | 3/2021 | Iijima | B41J 3/4075 |
| 2004/0056143 | A1 | 3/2004 | Nonomura | |
| 2004/0161278 | A1 | 8/2004 | Harada | |
| 2006/0088802 | A1 | 4/2006 | Akaiwa | |
| 2007/0172293 | A1 | 7/2007 | Vandermeulen | |
| 2011/0103871 | A1 | 5/2011 | Van Coppenolle et al. | |
| 2020/0207115 | A1 | 7/2020 | Ishimoto et al. | |

FOREIGN PATENT DOCUMENTS

| | | | |
|---|---|---|---|
| CN | 1469811 | A | 1/2004 |
| CN | 1762720 | A | 4/2006 |
| CN | 1950214 | A | 4/2007 |
| CN | 108638674 | A | 10/2018 |
| CN | 108928141 | A | 12/2018 |
| JP | 2003-11435 | A | 1/2003 |
| JP | 2014-43111 | A | 3/2014 |
| JP | 2017-056713 | A | 3/2017 |

* cited by examiner

PRINTING DEVICE HAVING RECEIVING PORTION FOR SELECTIVELY RECEIVING ONE OF FIRST CASSETTE AND SECOND CASSETTE

CROSS REFERENCE TO RELATED APPLICATION

This application is a continuation application claiming priority benefit under 35 U.S.C. 120 of U.S. patent application Ser. No. 16/734,324 filed on Jan. 4, 2020 and is based upon and claims the benefit of priority under 35 U.S.C. 119 from Japanese patent application No. 2019-032869, filed on Feb. 26, 2019, the entire contents of both of which are incorporated herein by reference.

TECHNICAL FIELD

The present disclosure relates to a printing device.

BACKGROUND

Japanese Patent Application Publication No. 2003-011435 discloses a printing device including a main body, a cassette attachment portion, and a lid. The cassette attachment portion is provided in the main body, and is configured to allow selected one of two tape cassettes having different sizes from each other to be attached to the cassette attachment portion.

SUMMARY

However, in the above-described conventional printing device, the cassette attachment portion has a dimension in conformity with a dimension of the larger tape cassette. Therefore, a larger space is required for placing the printing device, which is disadvantageous for a user who does not use the lager tape cassette.

In view of the foregoing, it is an object of the disclosure to provide a compact printing device capable of selectively receiving one of two types of cassettes having sizes different from each other.

In order to attain the above and other objects, according to one aspect, the disclosure provides a printing device including a housing, a print head, a cassette receiving portion, and a movable cover. The print head is provided in the housing and extends in a first direction. The cassette receiving portion is provided in the housing and is open in a second direction orthogonal to the first direction. The cassette receiving portion is configured to receive selected one of a first cassette and a second cassette, the second cassette having a size greater than a size of the first cassette. The movable cover is connected to the housing and is movable between a closed position and an open position. The movable cover is configured to cover the cassette receiving portion in the second direction at the closed position, and the movable cover is configured to expose the cassette receiving portion in the second direction at the open position. The cassette receiving portion provides: a first cassette receiving portion; and a second cassette receiving portion. The first cassette receiving portion is configured to receive the first cassette with the movable cover being at the closed position. The second cassette receiving portion is configured to receive the second cassette with the movable cover being at the open position. At least a portion of the second cassette receiving portion is overlapped with the movable cover at the closed position in the first direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, a printing device 1 according to one embodiment will be described with reference to FIGS. 1 through 8.

Figure 2:
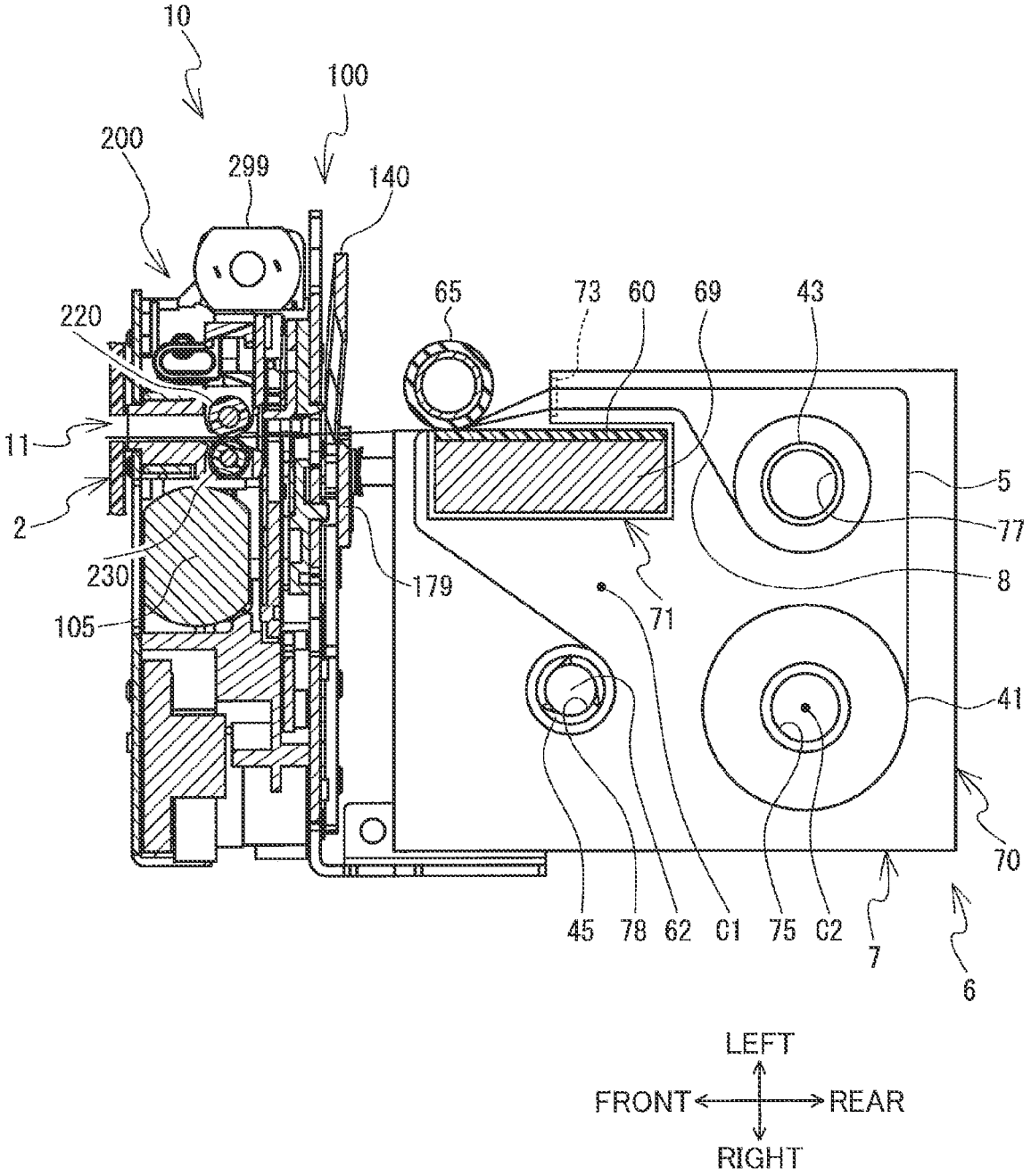
FIG. 2 is a cross-sectional view of the printing device according to the embodiment in a state where a first cassette is attached.
Figure 3:
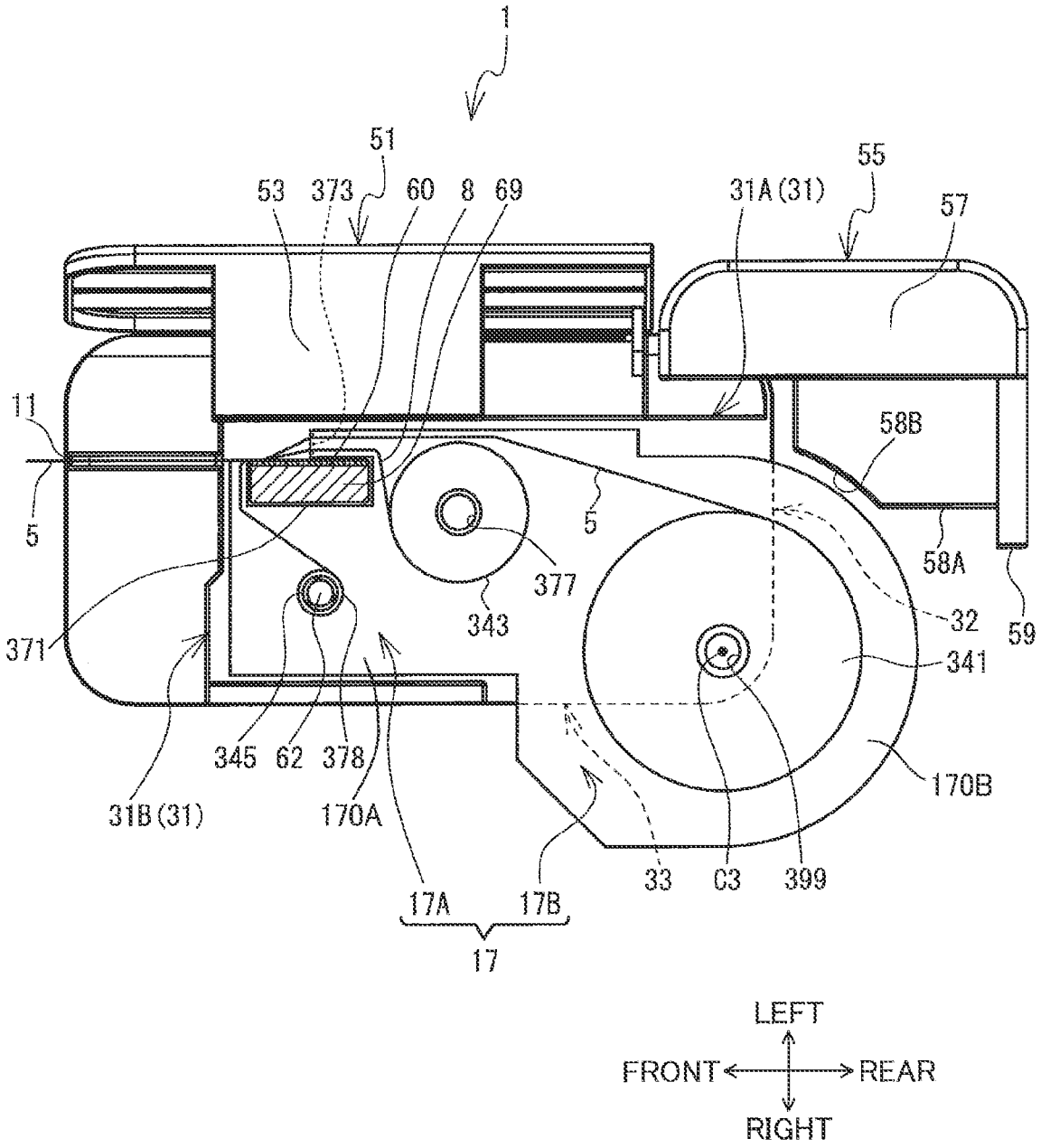
FIG. 3 is a partial cross-sectional plan view of the printing device according to the embodiment in a state where a second cassette is attached.
Figure 4:
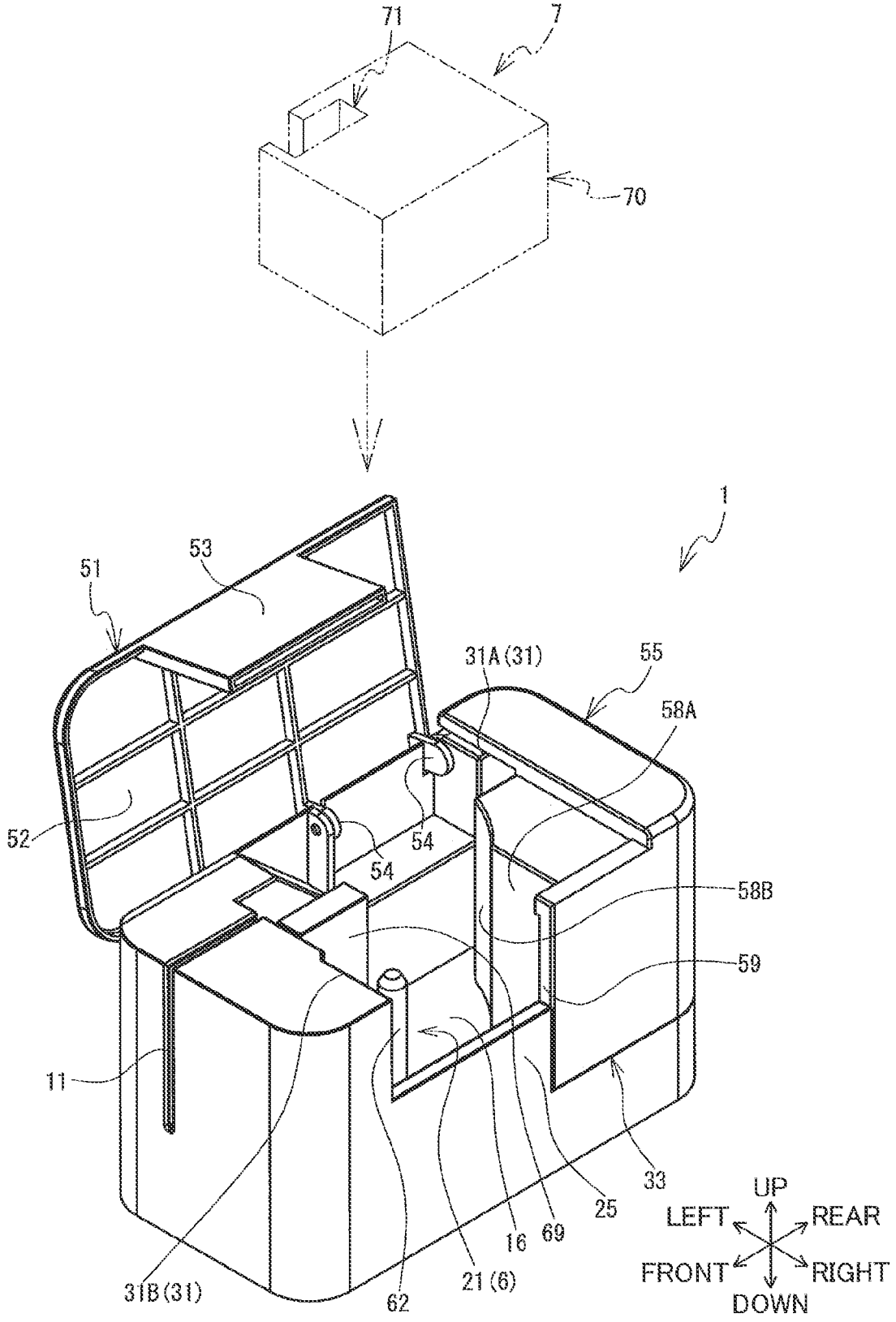
FIG. 4 is a perspective view of the printing device according to the embodiment prior to attachment of the first cassette.
Figure 5:
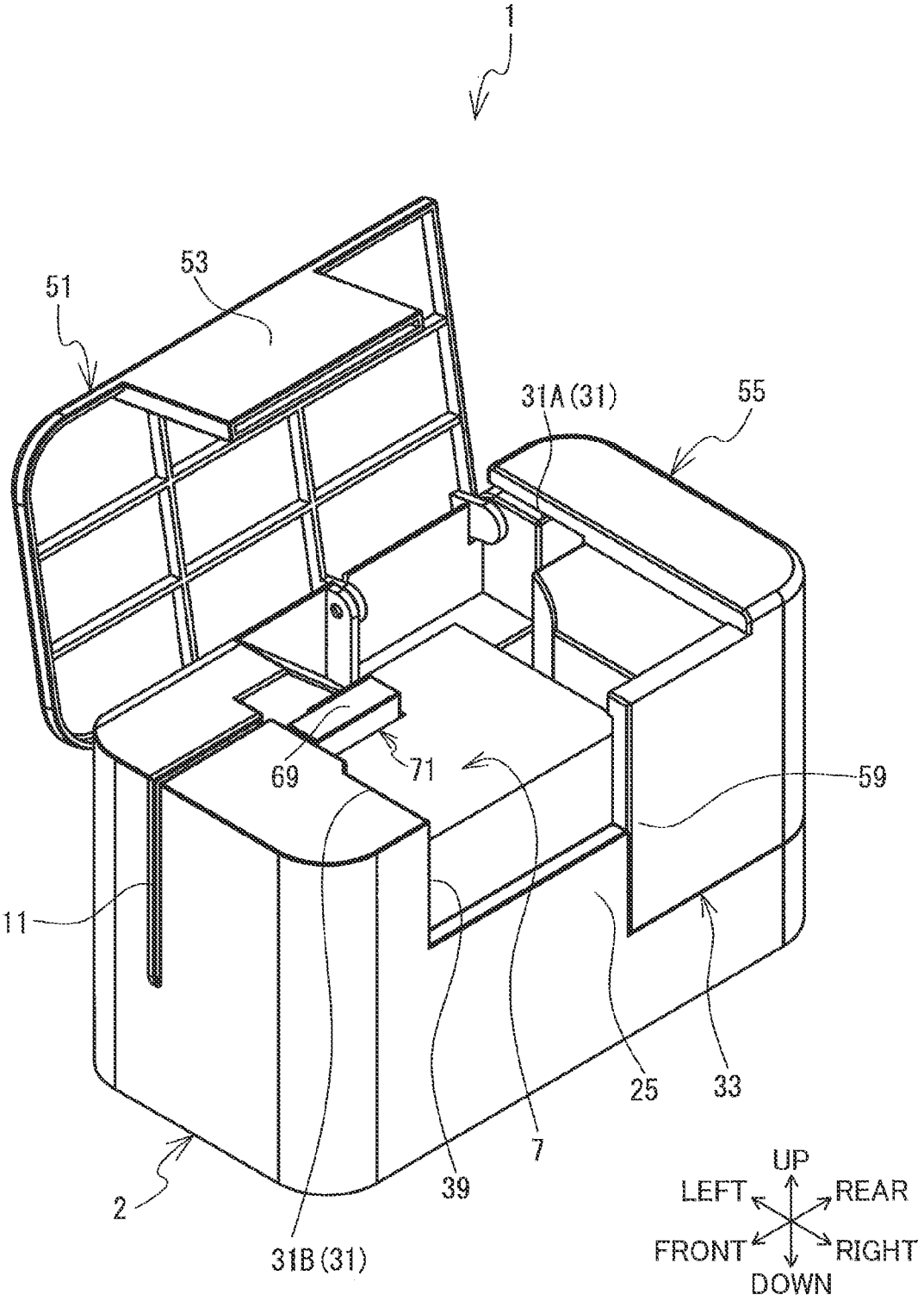
FIG. 5 is a perspective view of the printing device according to the embodiment after attachment of the first cassette.
Figure 7:
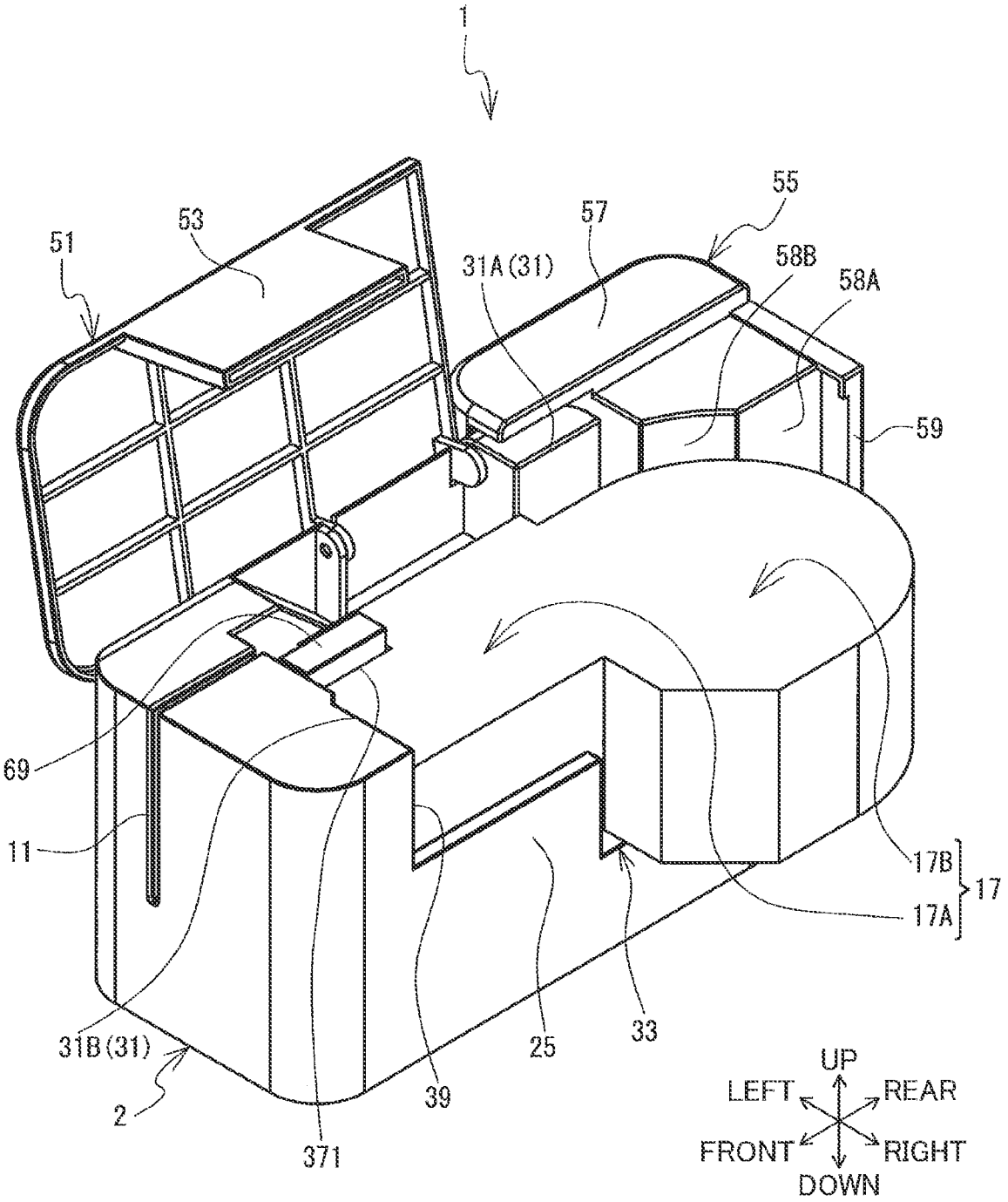
FIG. 7 is a perspective view of the printing device according to the embodiment after attachment of the second cassette in a state where the housing cover is opened.
Figure 8:
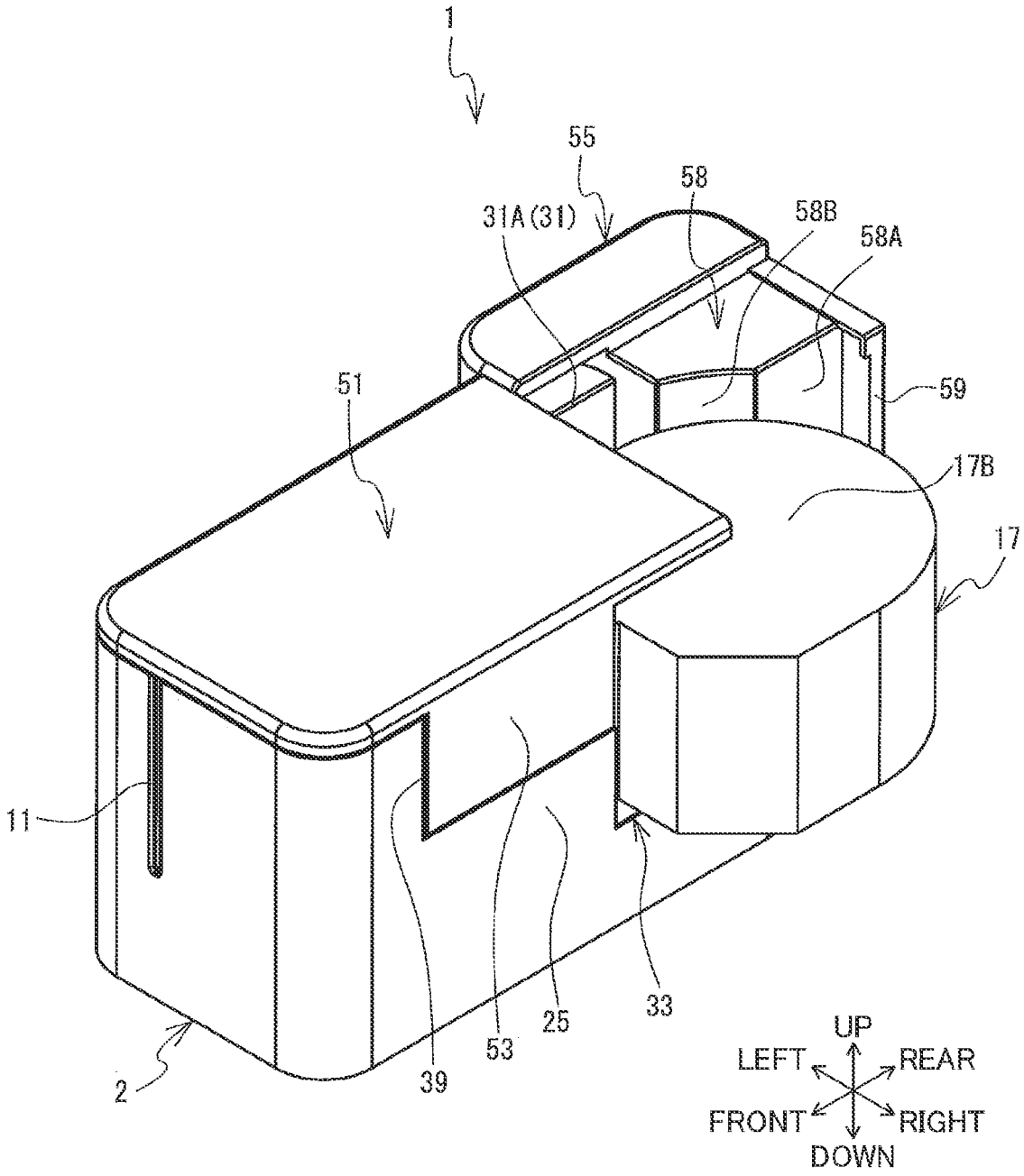
FIG. 8 is another perspective view of the printing device according to the embodiment after attachment of the second cassette in a state where the housing cover is opened.

The printing device 1 is configured to selectively receive one of a first cassette 7 and a second cassette 17 having sizes different from each other. The second cassette 17 is larger in size than the first cassette 7. Incidentally, the first cassette 7 is schematically illustrated in FIGS. 2, 4, and 5, whereas the second cassette 17 is schematically illustrated in FIGS. 3, 7, and 8.

In the following description, directions with regard to the printing device 1 will be described based on a posture of the printing device 1 illustrated in FIG. 1. Specifically, a diagonally upper leftward direction, a diagonally lower rightward direction, a diagonally lower leftward direction, a diagonally upper rightward direction, an upward direction, and a downward direction in FIG. 1 will be referred to as a leftward direction, a rightward direction, a frontward direction, a rearward direction, an upward direction, and a downward direction of the printing device 1, respectively.

First, an outline of the printing device 1 will be described with reference to FIGS. 1 and 2.

The printing device 1 includes a housing 2 having a generally rectangular parallelepiped shape. The housing 2 includes a bottom part 2A in which an electrical circuit board (not illustrated) extending in a leftward/rightward direction and a frontward/rearward direction is accommodated. The electrical circuit board is provided with a CPU and a USB connecting portion, and the like. The CPU is configured to control overall operations performed in the printing device 1.

Figure 1:
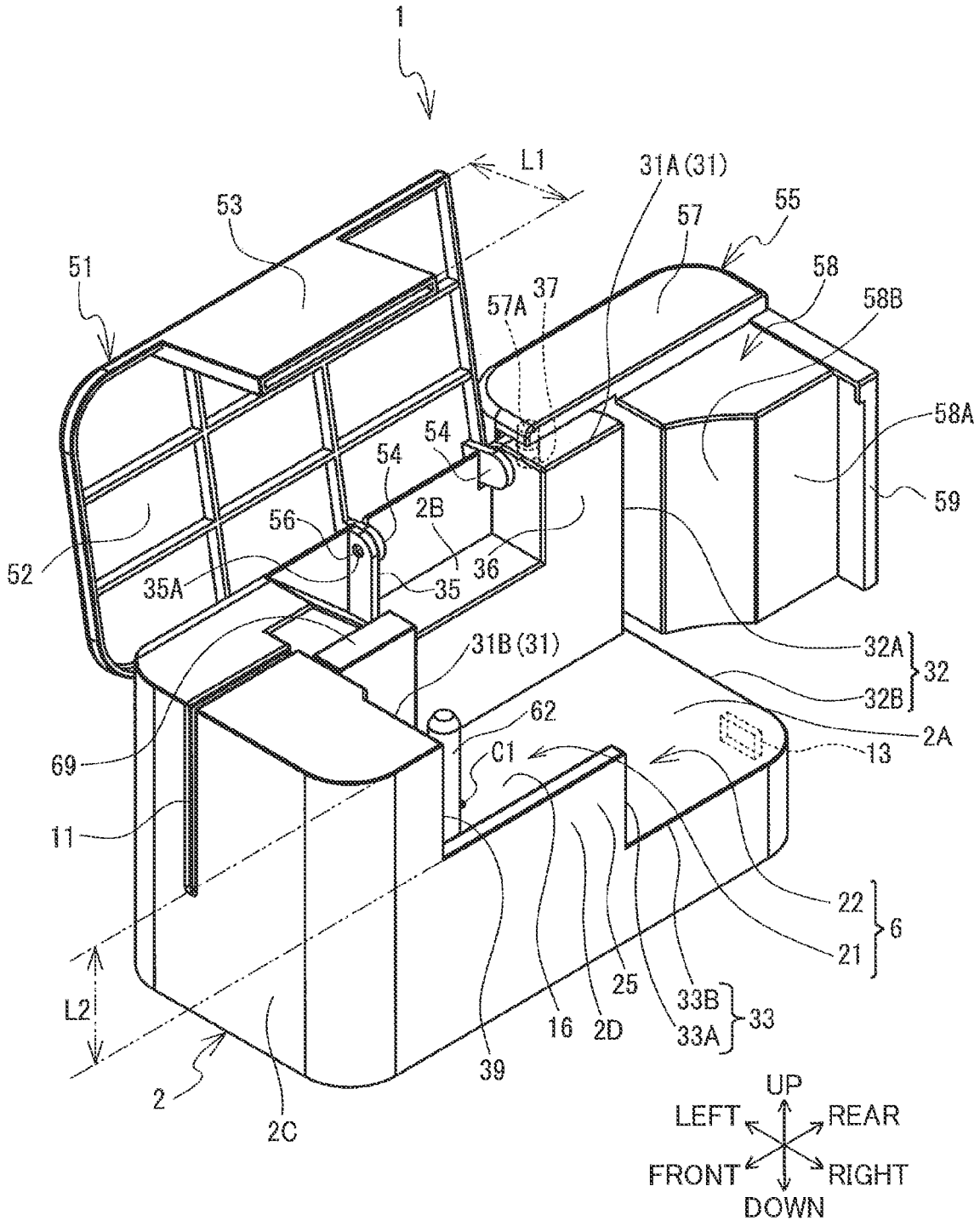
FIG. 1 is a perspective view of a printing device according to one embodiment.

The bottom part 2A has a rear end portion formed with an insertion hole 13 opening rearward (see FIG. 1). The housing 2 has a center C1 in the leftward/rightward direction and the frontward/rearward direction. The insertion hole 13 is positioned offset rightward relative to the center C1 in the leftward/rightward direction. The USB connecting portion is positioned inside the insertion hole 13. An USB cable (not illustrated) is connectable to the USB connecting portion through the insertion hole 13. One end portion of the USB cable is inserted into the insertion hole 13 to be connected to the USB connecting portion, and another end portion of the USB cable is connectable to a personal computer (not illustrated). The printing device 1 is configured to print character(s) on a tape 5 according to print data transmitted through the USB cable. The characters may be letters, numerals, symbols, and diagrams.

The housing 2 includes a left side part 2B connected to the bottom part 2A and extending in the frontward/rearward direction and an upward/downward direction. In the left side part 2B, an input portion (not illustrated) is provided. The input portion is in a form of buttons for inputting various information into the printing device 1.

The housing 2 also includes a front side part 2C connected to the bottom part 2A and the left side part 2B and extending in the leftward/rightward direction and upward/downward direction. A discharge opening 11 is formed in the front part 2C. The discharge opening 11 extends in the frontward/rearward direction and is open frontward and rearward. The discharge opening 11 is positioned offset leftward relative to the center C1 in the leftward/rightward direction. The discharge opening 11 provides communication between an inside and an outside of the housing 2 in the printing device 1.

The housing 2 further includes a right side part 2D connected to the bottom part 2A and the front part 2C and extending in the frontward/rearward direction and upward/downward direction. A cassette receiving portion 6 is provided as a space defined by the bottom part 2A, the left side part 2B, the front side part 2C, and the right side part 2D. In other words, the cassette receiving portion 6 is a recessed portion recessed downward from a top surface of the housing 2.

Selected one of the first cassette 7 and the second cassette 17 is attachable to the cassette receiving portion 6. A front end of the first cassette 7 attached to the cassette receiving portion 6 is at the same position as a front end of the second cassette 17 attached to the cassette receiving portion 6 (see FIGS. 5 and 7). Further, a left end of the first cassette 7 attached to the cassette receiving portion 6 is at the same position as a left end of the second cassette 17 attached to the cassette receiving portion 6 (see FIGS. 5 and 7).

The bottom part 2A has an upper surface 16, which is a lower end of the cassette receiving portion 6. The upper surface 16 extends in the leftward/rightward direction and frontward/rearward direction. The upper surface 16 functions as a surface adapted to oppose and contact one of the first cassette 7 and the second cassette 17 attached to the cassette receiving portion 6 from below thereof. The upper surface 16 will be referred to as an opposing surface 16, hereinafter.

The cassette receiving portion 6 provides a first cassette receiving portion 21, and a second cassette receiving portion 22. The first cassette receiving portion 21 is adapted to receive the first cassette 7 therein. The first cassette receiving portion 21 constitutes a front portion of the cassette receiving portion 6. Hence, a front portion of the opposing surface 16 constitutes a lower end of the first cassette receiving portion 21.

The second cassette receiving portion 22 is adapted to receive the second cassette 17 therein. In the present embodiment, the second cassette receiving portion 22 in its entirety is coincident with the cassette receiving portion 6. Hence, an entirety of the opposing surface 16 constitutes a lower end of the second cassette receiving portion 22. The second cassette receiving portion 22 contains the first cassette receiving portion 21.

The cassette receiving portion 6 has a first open end 31, a second open end 32, and a third open end 33.

The first open end 31 is open upward and constitutes an open upper end of the cassette receiving portion 6. The first open end 31 also constitutes an open upper end of the first cassette receiving portion 21, as well as an open upper end of the second cassette receiving portion 22.

Referring to FIG. 1, the first open end 31 is defined by: a first outline part 31A extending in the frontward/rearward direction; and a second outline part 31B extending in the leftward/rightward direction. More specifically, the left side part 2B includes a rear wall portion 36 having a top horizontal surface and an inner vertical surface facing rightward. The first outline part 31A is an intersection between the top horizontal surface and the inner vertical surface of the rear wall portion 36. The front side part 2C includes a protruding wall portion 39 having a top horizontal surface and a rear vertical surface. The second outline part 31B is an intersection between the top horizontal surface and the rear vertical surface.

The second open end 32 is open rearward and constitutes a rear open end of the cassette receiving portion 6. The second open end 32 also constitutes an open rear portion of the second cassette receiving portion 22.

Specifically, the second open end 32 is defined by: a first outline part 32A extending in the upward/downward direction; and a second outline part 32B extending in the leftward/rightward direction. The first outline part 32A is an intersection between the inner vertical surface of the rear wall portion 36 a rear surface of the rear wall portion 36. The second outline part 32B is an intersection between an upper surface of the bottom part 2A (opposing surface 16) and a rear surface of the bottom part 2A. The second outline part 32B extends rightward from a bottom end of the first outline part 32A.

The third open end 33 is open rightward and constitutes a right open end of the cassette receiving portion 6. The third open end 33 also constitutes a part of the second cassette receiving portion 22.

Specifically, the right side part 2D includes a wall portion 25 having a rectangular plate shape in a right side view. The wall portion 25 extends upward from the bottom part 2A and defines a right end of the first cassette receiving portion 21. The wall portion 25 has a front end connected to the protruding wall portion 39. The protruding wall portion 39 protrudes further upward than the wall portion 25. The third open end 33 is positioned rearward of the wall portion 25.

The third open end 33 is defined by: a first outline part 33A extending vertically; and a second outline part 33B extending in the frontward/rearward direction. The first outline part 33A is an intersection between a right end surface and a rear end surface of the wall portion 25. The second outline part 33B is an intersection between the upper surface (opposing surface 16) and a right surface of the bottom part 2A. A vertical position of the second outline part 33B of the third open end 33 is the same as that of the second outline part 32B of the second open end 32.

As illustrated in FIG. 1, the left side part 2B also includes a front wall portion 35 opposing the rear wall portion 36 in the frontward/rearward direction. The front wall portion 35 extends vertically, and is spaced away from the rear wall portion 36. The front wall portion 35 has an upper end portion formed with a cylindrical hole 35A extending therethrough in the frontward/rearward direction. The cylindrical hole 35A has a circular shape in a front view.

The rear wall portion 36 has an upper end portion formed with a cylindrical engagement hole (not illustrated) and a support hole 37. The engagement hole extends in the frontward/rearward direction and is open frontward. The engagement hole is circular in a front view and is coaxial with the cylindrical hole 35A. the support hole 37 is positioned rearward of the engagement hole and is open upward on the top surface of the rear wall portion 36. The support hole 37 has a circular cross-section.

The printing device 1 further includes a housing cover 51 configured to open and close the first open end 31. The housing cover 51 includes a base portion 52, a pair of protruding portions 54, a pair of engagement portions 56, and a protruding cover 53.

The base portion 52 is plate shaped. The pair of protruding portions 54 is provided at one end portion (a left end portion) of the base portion 52 with respect to the leftward/rightward direction. The protruding portions 54 are arranged to be spaced apart from each other in the frontward/rearward direction. The protruding portions 54 protrude from the left end portion of the base portion 52 in a thickness direction of the base portion 52.

Each of the pair of engagement portions 56 protrudes from each tip end portion of corresponding one of the pair of protruding portions 54 in the frontward/rearward direction. Specifically, a front one of the engagement portions 56 protrudes frontward from a tip end portion of a front one of the protruding portions 54, and a rear engagement portion 56 (not illustrated) protrudes rearward from a rear one of the protruding portions 54. The front one of the engagement portions 56 is rotatably fitted with the cylindrical hole 35A of the front wall portion 35, and the rear one of the engagement portions 56 (not illustrated) is rotatably fitted with the engagement hole (not illustrated) of the rear wall portion 36. Hence, the housing cover 51 is pivotably supported by the left side part 2B.

Figure 6:
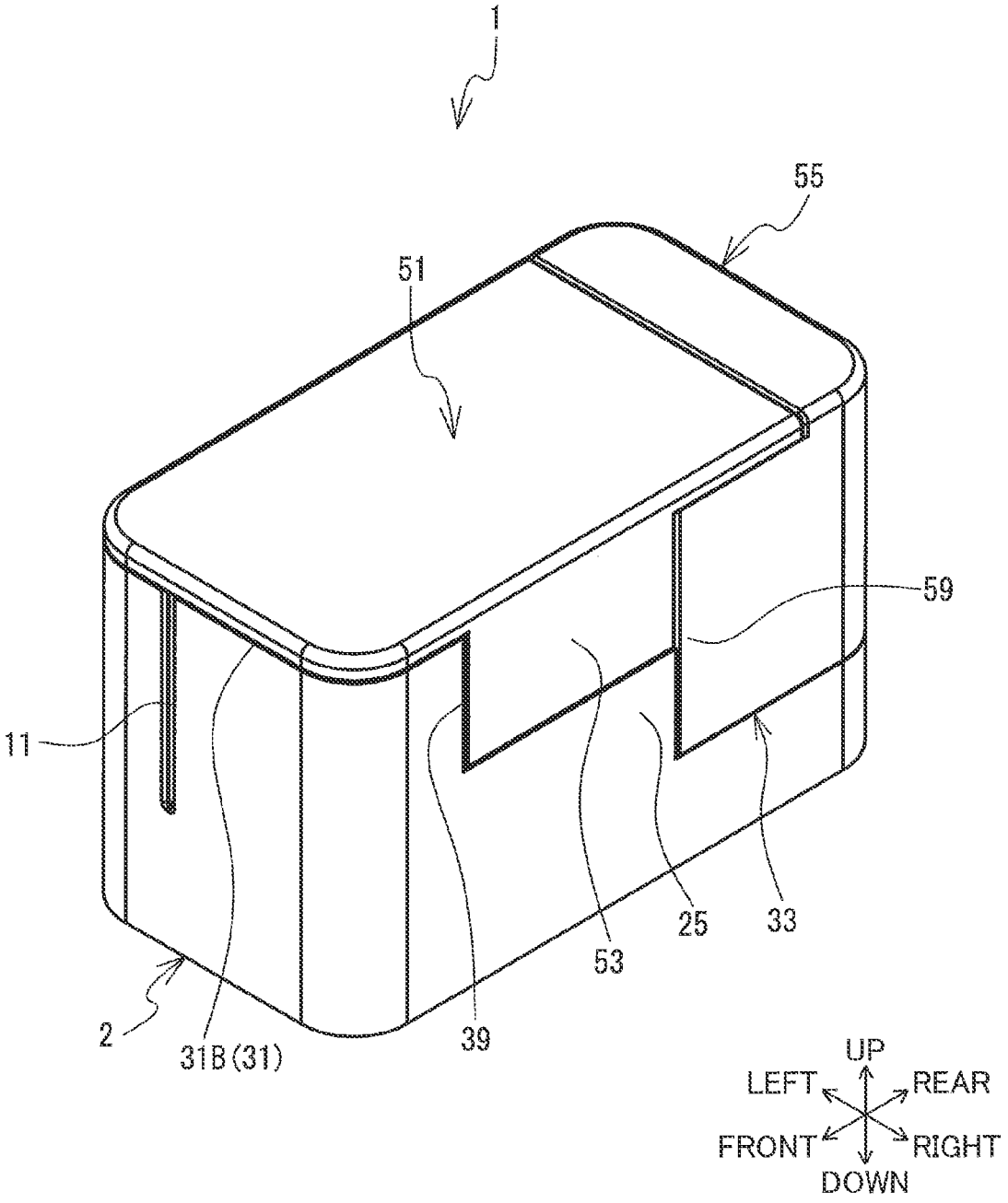
FIG. 6 is a perspective view of the printing device according to the embodiment in a state where a housing cover and a movable cover are closed.

The housing cover 51 is pivotally movable between an open position (FIG. 1) and a closed position (FIG. 6). At the open position, the housing cover 51 exposes the first open end 31 upward. At the closed position, the housing cover 51 closes the first open end 31 from above. At the closed position of the housing cover 51, a front end portion of the base portion 52 faces the protruding wall portion 39, and the left end portion of the base portion 52 faces the left side part 2B. A pivotally moving direction of the housing cover 51 from the open position to the closed position will be referred to as a "closing direction" as appropriate, hereinafter.

The protruding cover 53 is provided at another end portion (a right end portion) of the base portion 52. The protruding cover 53 protrudes from the other end portion in the closing direction. In the closed position of the housing cover 51, a tip end face of the protruding cover 53 faces a top surface of the wall portion 25. The protruding cover 53 has a first protruding length L1 that is equal to or greater than a second protruding length L2 by which the protruding wall portion 39 protrudes upward from the wall portion 25 in a direction opposite to the closing direction.

The printing device 1 further includes a movable cover 55. The movable cover 55 is configured to open and close the second open end 32 and the third open end 33. The movable cover 55 includes a base portion 57, and a protruding wall portion 58. The base portion 57 is plate shaped, and has a generally rectangular shape in a plan view. The base portion 57 has one end portion positioned above the rear wall portion 36. A shaft portion 57A is provided at the one end portion of the base portion 57 to protrude downward therefrom. The shaft portion 57A is rotatably fitted with the support hole 37 of the rear wall portion 36. Hence, the movable cover 55 is pivotally movably supported by the rear wall portion 36 of the left side part 2B about an axis of the shaft portion 57A. The movable cover 55 is pivotally movable in a first rotational direction toward the rear surface of the wall portion 25, and in a second rotational direction (opposite the first rotational direction) away from the rear surface of the wall portion 25.

The base portion 57 has another end portion to which the protruding wall portion 58 is connected. The protruding wall portion 58 is so positioned and shaped to avoid interference with the rear wall portion 36. The protruding wall portion 58 protrudes from the base portion 57 in a clockwise direction (the first rotational direction) about the axis of the shaft portion 57A in a plan view.

The protruding wall portion 58 includes an abutment portion 59, a guide portion 58A, and a curved portion 58B. The abutment portion 59 is a radially outermost end portion of the protruding wall portion 58 about the axis of the shaft portion 57A. In other words, the abutment portion 59 is a downstream end of the protruding wall portion 58 in the first rotational direction. That is, the abutment portion 59 constitutes a free end portion of the protruding wall portion 58 in the clockwise direction about the axis of the shaft portion 57A in a plan view.

The guide portion 58A and the curved portion 58B are positioned between the shaft portion 57A and the abutment portion 59. The guide portion 58A extends vertically and perpendicular to the first rotational direction. That is, the guide portion 58A faces downstream in the first rotational direction. As described later, the guide portion 58A is configured to guide attachment of the first cassette 7 to the first cassette receiving portion 21.

The curved portion 58B is curved in an arcuate shape such that the curved portion 58B is recessed toward the other end portion of the base portion 57. The guide portion 58A and the curved portion 58B are positioned further in the second rotational direction (upstream in the first rotational direction) relative to the abutment portion 59.

The movable cover 55 is pivotally movable about the support hole 37 (i.e., the axis of the shaft portion 57A) between an open position (FIG. 1) and a closed position (FIG. 4). The second open end 32 and the third open end 33 are open (exposed) at the open position. At the open position of the movable cover 55, the base portion 57 extends generally in the frontward/rearward direction. The second open end 32 and the third open end 33 are closed by the movable cover 55 at the closed position. At the closed position, the base portion 57 extends generally in the leftward/rightward direction; the protruding wall portion 58 is positioned above the second outline part 32B of the second open end 32 and the second outline part 33B of the third open end 33; and the free end face of the abutment portion 59 is in contact with the rear surface of the wall portion 25. In other words, at least a part of the movable cover 55 is overlapped with the second cassette receiving portion 22 in the upward/downward direction when the movable cover 55 is at the closed position.

The guide portion 58A and the curved portion 58B are positioned further in the second rotational direction relative to the free end face of the abutment portion 59 (downstream end of the abutment portion 59 in the first rotational direction). Therefore, the guide portion 58A and the curved portion 58B are less likely to make contact with the first cassette 7 when the movable cover 55 is at the closed position.

As illustrated in FIGS. 1 and 2, a head holder 69, a print head 60, and a ribbon take-up shaft 62 are provided in the cassette receiving portion 6. The head holder 69 and the print head 60 are positioned leftward of the center C1 of the housing 2. The ribbon take-up shaft 62 is positioned rightward of the center C1 of the housing 2.

The head holder 69 extends upward from a left front portion of the opposing surface 16 of the cassette receiving portion 6. The print head 60 is positioned on a left surface of the head holder 69. The print head 60 is a thermal head including a plurality of heat generating elements arrayed in line in the upward/downward direction. Alternatively, a plurality of the heat generating elements may be arrayed in line in the frontward/rearward direction. The ribbon take-up shaft 62 is positioned rightward of the head holder 69 and extends in the upward/downward direction. The ribbon take-up shaft 62 is rotatable about an axis thereof. A platen roller 65 is positioned leftward of the print head 60 to face the same in the leftward/rightward direction. The ribbon take-up shaft 62 and the platen roller 65 are drivingly connected to a conveyer roller (not illustrated) through a plurality of gears (not illustrated).

An internal unit 10 is provided in an interior of the front part 2C of the housing 2 at a position adjacent to the discharge opening 11. The internal unit 10 includes a cutter unit 100 and a discharge unit 200. The cutter unit 100 is configured to perform a cutting operation to the tape 5. The cutting operation includes a full-cutting operation for completely cutting the tape 5 into two separate parts. Specifically, according to the full-cutting, the tape 5 is cut over an entire width and an entire thickness of the tape 5 (i.e., the tape 5 is cut off in a widthwise direction and a thickness direction thereof).

The cutter unit 100 includes a fixed blade 179, a movable blade (full-cutting blade) 140, and a cutter motor 105. The fixed blade 179 and the movable blade 140 are arranged to oppose each other in the leftward/rightward direction. The movable blade 140 is movable in the leftward/rightward direction between a remote position (FIG. 2) and a full-cutting position (not illustrated) by a driving force from the cutter motor 105. At the remote position, the movable blade 140 is positioned away from or leftward of the fixed blade 179. At the full-cutting position, the movable blade 140 is positioned such that the tape 5 is nipped between the movable blade 140 and the fixed blade 179 to perform the full-cutting operation to the tape 5.

The discharge unit 200 is configured to hold the tape 5 cut by the cutter unit 100, and to discharge the tape cut by the cutter unit 100 frontward through the discharge opening 11. The discharge unit 200 includes a discharge roller 220, an opposing roller 230, and a discharge motor 299. The opposing roller 230 and the discharge roller 220 are arranged to oppose each other in the leftward/rightward direction. The discharge roller 220 is configured to nip the tape 5 in cooperation with the opposing roller 230, and to eject the tape 5 frontward by a driving force from the discharge motor 299. At this time, the opposing roller 230 is rotated by rotation of the discharge roller 220. The discharge unit 200 thus ejects the tape 5 frontward through the discharge opening 11.

Next, the first cassette 7 will be described with reference to FIG. 2. In the following description, a structure of the first cassette 7 will be described based on an assumption that the first cassette 7 is attached to the first cassette receiving portion 21. The first cassette 7 includes a case 70 of a box shape. The case 70 is formed with support holes 75, 77, 78, a tape discharge opening 73, and a head opening 71.

The support hole 75, the support hole 77, and the support hole 78 extend throughout a thickness of the case 70 in the upward/downward direction. The tape discharge opening 73 is positioned at a front end of a left end portion of the case 70, and is open frontward. The head opening 71 is in a form of a notch and is positioned at a front half portion of the left end portion of the case 70, as illustrated in FIG. 4. The head opening 71 extends through the thickness of the case 70 in the upward/downward direction.

A first tape spool 41, a ribbon spool 43, and a ribbon take-up spool 45 are provided inside the case 70 of the first cassette 7. The first tape spool 41 extends in the upward/downward direction, and the tape 5 is wound over the first tape spool 41. The first tape spool 41 is rotatably supported by the support hole 75. The tape 5 paid out from the first tape spool 41 is drawn out through the tape discharge opening 73. The tape 5 drawn out through the tape discharge opening 73 moves through a portion between the platen roller 65 and the print head 60, and is discharged toward the internal unit 10. Incidentally, the first tape spool 41 defines a central axis C2 that is positioned rightward of the print head 60. In other words, the print head 60 is positioned offset from the central axis C2 toward the left.

The ribbon spool 43 extends in the upward/downward direction, and an ink ribbon 8 for use in printing is wound over the ribbon spool 43. The ribbon spool 43 is rotatably supported by the support hole 77. The ribbon take-up spool 45 is a hollow cylindrical member extending in the upward/downward direction. The ribbon take-up spool 45 is rotatably supported by the support hole 78. The ribbon take-up shaft 62 of the first cassette receiving portion 21 (cassette receiving portion 6) is inserted in the ribbon take-up spool 45. The ink ribbon 8 used for printing is wound over the ribbon take-up spool 45. The ink ribbon 8 paid out from the ribbon spool 43 is drawn out through the tape discharge opening 73, moves through the portion between the platen roller 65 and the print head 60 along with the tape 5, and is entered into the case 70 and wound over the ribbon take-up spool 45.

The print head 60 and the head holder 69 of the first cassette receiving portion 21 are inserted in the head opening 71 upon attachment of the first cassette 7 to the first cassette receiving portion 21. The tape 5 and the ink ribbon 8 drawn out through the tape discharge opening 73 move frontward along a left side of the head opening 71.

Next, the second cassette 17 will be described with reference to FIG. 3. In the following description, a structure of the second cassette 17 will be described based on a posture of the second cassette 17 that is attached to the second cassette receiving portion 22. Incidentally, a cross-sectional plane for illustrating FIG. 3 is at the same height as a cross-sectional plane for illustrating FIG. 2 for better understanding to the second cassette 17 in connection with the head holder 69.

The second cassette 17 includes a front part 17A and a rear part 17B. The front part 17A constitutes a front portion of the second cassette 17, and has a structure approximately the same as the structure of the first cassette 7. The position of the front part 17A of the second cassette 17 attached to the second cassette receiving portion 22 is approximately the same as the position of the first cassette 7 attached to the first cassette receiving portion 21.

The front part 17A includes a case front part 170A, and the rear part 17B includes a case rear part 170B integral with the case front part 170A. The case front part 170A is formed with support holes 377 and 378, a tape discharge opening 373 and a head opening 371. The support hole 377 and the support hole 378 extend through a thickness of the case front part 170A in the upward/downward direction. The support hole 377 has a structure the same as that of the support hole 77 of the first cassette 7. The support hole 378 has a structure the same as that of the support hole 78 of the first cassette 7.

A ribbon spool 343 and a ribbon take-up spool 345 are positioned inside the case front part 170A. The support hole 377 rotatably supports the ribbon spool 343. A ink ribbon 8 for use in printing is wound over the ribbon spool 343. The ink ribbon 8 wound over the ribbon spool 343 has a length greater than that of the ink ribbon 8 wound over the ribbon spool 43 of the first cassette 7. Hence, prior to use of the second cassette 17 and first cassette 7, the ink ribbon 8 wound over the ribbon spool 343 has a larger diameter than the ink ribbon 8 wound over the ribbon spool 43 of the first cassette 7. The support hole 378 rotatably supports the ribbon take-up spool 345. The ribbon take-up shaft 62 of the cassette receiving portion 6 (second cassette receiving portion 22) is inserted in the ribbon take-up spool 345 when the second cassette 17 is attached to the second cassette receiving portion 22. The ink ribbon 8 used for printing is taken up by the ribbon take-up spool 345 and wound over the ribbon take-up spool 345.

The tape discharge opening 373 and the head opening 371 are shaped to be identical to the shapes of the tape discharge opening 73 and the head opening 71, respectively. Further, the ink ribbon 8 ejected from the tape discharge opening 373 is to be conveyed along a conveying passage that is identical to a conveying passage along which the ink ribbon ejected from the tape discharge opening 73 is conveyed thereafter.

The rear part 17B constitutes a rear portion of the second cassette 17. The rear part 17B protrudes rearward through the second open end 32 and rightward through the third open end 33. The case rear part 170B has a rear end portion (protruding out through the second open end 32) that does not make contact with the movable cover 55 which is at the open position. The rear end portion of the case rear part 170B is semicircular shaped in a plan view. Here, the semicircular shape is concentric with the arcuate shape of the curved portion 58B of the movable cover 55 which is at the open position. The semicircular rear end portion is in confrontation with the curved portion 58B with a gap therebetween when the movable cover 55 is at the open position.

The case rear part 170B is formed with a support hole 399, and a first tape spool 341 is positioned inside the case rear part 170B. The support hole 399 extends throughout the case rear part 170B in the upward/downward direction. The support hole 399 rotatably supports the first tape spool 341. A length of the tape 5 wound over the first tape spool 341 is greater than a length of the tape 5 wound over the first tape spool 41 of the first cassette 7. Hence, prior to use of the first cassette 7 and second cassette 17, the tape 5 wound over the first tape spool 341 has a larger diameter than the tape 5 wound over the first tape spool 41 of the first cassette 7.

The tape 5 paid out from the first tape spool 341 is ejected through the tape discharge opening 373. The tape 5 ejected through the tape discharge opening 373 is then to be conveyed along a conveying passage that is identical to a conveying passage along which the tape 5 ejected from the tape discharge opening 73 of the first cassette 7 is to be conveyed. Incidentally, the first tape spool 341 defines a central axis C3 that is approximately at the same left-right position as the central axis C2 of the first tape spool 41 of the first cassette 7. In other words, the print head 60 is positioned offset from the central axis C3 toward the left.

Next, a printing process performed in the printing device 1 and using the first cassette 7 will be described with reference to FIGS. 2 and 4 through 6. Here, prior to attachment of the first cassette 7 to the first cassette receiving portion 21, the housing cover 51 is at the open position, the movable cover 55 is at the closed position (see FIG. 4), and the movable blade 140 is at the remote position.

For performing a printing operation with the first cassette 7, firstly, a user attaches the first cassette 7 to the first cassette receiving portion 21. More specifically, the first cassette 7 is placed above the first cassette receiving portion 21, and is moved downward. The first cassette 7 is thus entered into the interior of the housing 2 through the first open end 31. The guide portion 58A of the movable cover 55 restricts the first cassette 7 from moving rearward, while guiding the first cassette 7 to move downward. The ribbon take-up shaft 62 is inserted into the ribbon take-up spool 45; the head holder 69 and the print head 60 are inserted in the head opening 71; and the upper surface 16 comes into contact with the first cassette 7 from below. The first cassette 7 is thus attached to the first cassette receiving portion 21, as illustrated in FIG. 5.

Then, the housing cover 51 is pivotally moved from the open position (FIG. 5) to the closed position (FIG. 6). When the housing cover 51 reaches the closed position, the platen roller 65 comes to a position adjacent to the print head 60 and approaches the print head 60 from a left side thereof. The platen roller 65 presses, toward the print head 60, the tape 5 and the ink ribbon 8 in superposed relation those ejected through the tape discharge opening 73. The tape 5 and the ink ribbon 8 are nipped between the platen roller 65 and the print head 60.

Upon user's operation to the input portion, the conveyer motor and the discharge motor 299 are rotationally driven by the CPU to heat the heat generating elements of the print head 60. By the rotation of the conveyer motor, the platen roller 65 and the ribbon take-up shaft 62 respectively rotate in the clockwise direction in a plan view. By the rotation of the discharge motor 299, the discharge roller 220 rotates in the clockwise direction, and the opposing roller 230 rotates in a counterclockwise direction in a plan view.

By the rotation of the platen roller 65 and the ribbon take-up shaft 62, the tape 5 and the ink ribbon 8 nipped between the platen roller 65 and the print head 60 are both conveyed frontward. Ink of the ink ribbon 8 is thermally transferred onto the tape 5 through the heat applied to the ink ribbon 8 by the print head 60. In this way, the print head 60 can print character(s) on the tape 5.

The used ink ribbon 8 is wound over the ribbon take-up spool 45 by the rotation of the ribbon take-up shaft 62. The tape 5 printed by the print head 60 is conveyed into a position between the discharge roller 220 and the opposing roller 230. The tape 5 is conveyed frontward by the discharge roller 220 and the opposing roller 230, and a leading end portion of the tape 5 is ejected frontward through the discharge opening 11. The rotation of the conveyer motor and the discharge motor 299, and heat generation at the print head 60 are both stopped by the CPU.

Then, the cutter motor 105 is driven by the CPU to move the movable blade 140 from the remote position to the full-cutting position. The tape 5 is fully cut by the movable blade 140 and the fixed blade 179, and finally the cut tape 5 exposed through the discharge opening 11 is taken out by the user.

Incidentally, the first cassette 7 may be attached to the first cassette receiving portion 21 while the movable cover 55 is at the open position, rather than while the movable cover 55 is at its closed position. If the first cassette 7 is attached while the movable cover 55 is in its open position, the movable cover 55 may be moved to its closed position after the first cassette 7 is seated on the opposing surface 16.

Next, a printing process performed in the printing device 1 and using the second cassette 17 will be described with reference to FIGS. 1 through 3, 7, and 8. Here, prior to attachment of the second cassette 17 to the second cassette receiving portion 22, the housing cover 51 is at the open position, the movable cover 55 is at the open position (see FIG. 1), and the movable blade 140 is at the remote position.

For performing a printing operation with the second cassette 17, the second cassette 17 is first attached to the second cassette receiving portion 22. More specifically, the second cassette 17 is placed above the second cassette receiving portion 22, and is moved downward. The second cassette 17 is entered into the interior of the housing 2 through the first open end 31. The ribbon take-up shaft 62 is inserted into the ribbon take-up spool 345; the head holder 69 and the print head 60 are inserted in the head opening 371; and the upper surface 16 comes into contact with the second cassette 17 from below. The second cassette 17 is thus attached to the second cassette receiving portion 22, as illustrated in FIG. 7.

Then, the housing cover 51 is pivotally moved from the open position (FIG. 1) to the closed position (FIG. 8). When the housing cover 51 is at the closed position, the platen roller 65 comes to a position adjacent to the print head 60 and approaches the print head 60 from the left side thereof. The platen roller 65 presses, toward the print head 60, the tape 5 and the ink ribbon 8 in superposed relation and those ejected through the tape discharge opening 373.

The conveyer motor and the discharge motor 299 are rotationally driven by the CPU to heat the heat generating elements of the print head 60. The tape 5 is paid out from the first tape spool 341, and the ink ribbon 8 is paid out from the ribbon spool 343. Ink of the ink ribbon 8 is thermally transferred to the tape 5 by the heat applied from the print head 60. A used pat of the ink ribbon 8 is wound over the ribbon take-up spool 345 by the rotation of the ribbon take-up shaft 62.

Ejection of the printed tape 5 through the tape discharge opening 373 and full cutting operation by the cutter unit 100 to the printed tape 5 are the same as those performed with respect to the first cassette 7 attached to the first cassette receiving portion 21, and therefore, further description will be omitted. Further, the cut tape 5 is then to be ejected through the discharge opening 11 by the discharge unit 200 as in the same manner as that performed to the first cassette 7 attached to the first cassette receiving portion 21, and therefore, further description will be omitted.

As described above, one of the first cassette 7 and the second cassette 17 is selectively attachable to the cassette receiving portion 6. Specifically, the first cassette 7 is attachable to the first cassette receiving portion 21 with the movable cover 55 kept at the closed position, and the second cassette 17 is attachable to the second cassette receiving portion 22 with the movable cover 55 held at the open position. The movable cover 55 may be moved to the closed position, even after the first cassette 7 is attached to the first cassette receiving portion 21 while the movable cover 55 is at the open position. In either way, since the movable cover 55 can be placed at the closed position when receiving the first cassette 7, the printing device 1 can be made more compact than otherwise. Hence, the printing device 1 of the present embodiment can be smaller in size, while achieving selective receiving of one of the first cassette 7 and the second cassette 17 having different sizes from each other.

The second open end 32 permits the second cassette 17 attached to the second cassette receiving portion 22 to protrude rearward out of the housing 2. Hence, the printing device 1 can be made compact by the protruding amount of the second cassette 17.

The movable cover 55 is pivotally movable about the support hole 37 having circular shape in a plan view. In other words, the movable cover 55 is pivotally movable about an axis extending in upward/downward direction. Hence, the second open end 32 can be easily opened.

The first cassette 7 is attached to the first cassette receiving portion 21 while the movable cover 55 is at the closed position. The guide portion 58A can guide the first cassette 7 having entered into the interior of the housing 2 through the first open end 31 toward the first cassette receiving portion 21. With this structure, the first cassette 7 can be easily attached to the first cassette receiving portion 21 by the guiding function of the guide portion 58A.

The first protruding length L1 of the protruding cover 53 is equal to or greater than the second protruding length L2 of the protruding wall portion 39. Therefore, the base portion 52 of the housing cover 51 can avoid contact with the second cassette 17 attached to the second cassette receiving portion 22 when the housing cover 51 is at the closed position. Hence, the second cassette 17 can be stably attached to the second cassette receiving portion 22.

Various Modifications are Conceivable.

For example, the rear part 17B of the second cassette 17 may not necessarily protrude out through both of the second open end 32 and third open end 33 when attached to the second cassette receiving portion 22. Further, the second cassette receiving portion 22 may not have both of the second open end 32 and the third open end 33.

Further, the first cassette receiving portion 21 may not be contained in the second cassette receiving portion 22. For example, the first cassette receiving portion 21 and the second cassette receiving portion 22 may be arranged to be aligned with each other in the frontward/rearward direction. Still alternatively, the second cassette receiving portion 22 may not form the entire region of the cassette receiving portion 6, but may form a partial region of the cassette receiving portion 6.

Further, in the above-described embodiment, the movable cover 55 is pivotally movable about the axis (of the shaft portion 57A) extending in the upward/downward direction. However, the movable cover 55 may be pivotally movable about a pivot axis extending in the leftward/rightward direction. In the latter case, the shaft portion 57A may extend in the leftward/rightward direction, and the support hole 37 may have a circular shape in a side view. Still alternatively, the movable cover 55 may be linearly movable in the upward/downward direction. More specifically, in this case, the housing 2 may include a rail extending in the upward/downward direction, and the movable cover 55 may be connected to the rail so as to be movable along the rail in the upward/downward direction. The rail may be provided in a form of a groove formed in the housing 2. Or, the rail may be a slidable rail extending in the upward/downward direction, rather than a stationary rail.

Further, the housing cover 51 may be shaped to be capable of contacting with the second cassette 17 at the closed position of the housing cover 51. For example, the housing cover 51 at its closed position may press the second cassette 17 attached to the second cassette receiving portion 22 downward.

While the description has been made in detail with reference to specific embodiment thereof, it would be apparent to those skilled in the art that various changes and modifications may be made therein without departing from the scope of the above described embodiment.

<Remarks>

The printing device 1 is an example of a printing device. The housing 2 is an example of a housing. The first cassette 7 is an example of a first cassette. The second cassette 17 is an example of a second cassette. The cassette receiving portion 6 is an example of a cassette receiving portion. The first cassette receiving portion 21 is an example of a first cassette receiving portion. The second cassette receiving portion 22 is an example of a second cassette receiving portion. The movable cover 55 is an example of a movable cover. The housing cover 51 is an example of a housing cover. The upward direction is an example of a first direction. The rearward direction is an example of a second direction. The rightward direction is an example of a third direction.

What is claimed is:

1. A printing device comprising:

a housing having a discharge opening;

a first cassette receiving portion in communication with the discharge opening and configured to receive a first cassette, the first cassette receiving portion having a width in a left-right direction and extending in a front-rear direction perpendicular to the left-right direction;

a second cassette receiving portion configured to receive a second cassette, the second cassette comprising a case and a roll of a printing medium accommodated in the case, the roll of the printing medium having a diameter greater than the width in the left-right direction of the first cassette receiving portion; and a print head provided in the first cassette receiving portion, wherein the print head is configured to perform printing on the printing medium paid out from the roll of the second cassette received in the second cassette receiving portion in a state where an entirety of the roll is positioned rearward of the first cassette receiving portion in the front-rear direction.

2. The printing device according to claim 1, wherein the second cassette receiving portion receives the second cassette such that a rear end portion of the second cassette protrudes out of the housing.

3. The printing device according to claim 1, wherein the case of the second cassette has a first side wall formed with an outlet, wherein, when the second cassette receiving portion receives the second cassette, the print head performs printing on the printing medium ejected out of the case through the outlet toward the discharge opening.

4. The printing device according to claim 1, wherein the case of the second cassette received in the second cassette receiving portion provides a width greater than the width of the first cassette receiving portion in the left-right direction.

5. The printing device according to claim 1, further comprising a wall portion extending vertically and positioned farther away from the discharge opening than the second cassette receiving portion is from the discharge opening in the front-rear direction.

6. The printing device according to claim 1, wherein the print head is further configured to perform printing on a printing medium accommodated in a case of the first cassette received in the first cassette receiving portion.

7. The printing device according to claim 1, wherein the discharge opening extends in an up-down direction perpendicular to the front-rear direction and the left-right direction and is open frontward to provide communication between an inside and an outside of the housing in the front-rear direction.

8. The printing device according to claim 1, wherein the printing medium on which the printing is performed by the print head is configured to be discharged in the front-rear direction through the discharge opening.

9. The printing device according to claim 1, wherein the left-right direction is coincident with a thickness direction of the printing medium positioned at the print head for the printing thereby.

* * * * *